US005151108A

United States Patent [19]

Kitahara et al.

[11] Patent Number: 5,151,108

[45] Date of Patent: Sep. 29, 1992

[54] METHOD OF PRODUCING POROUS VITRIFIED GRINDER

[75] Inventors: Motohide Kitahara, Kyoto; Hiroshi Ozaki, Osaka; Kouji Shishido, Mei, all of Japan

[73] Assignee: Nissan Chemical Industries, Ltd., Tokyo, Japan

[21] Appl. No.: 680,142

[22] Filed: Apr. 3, 1991

[30] Foreign Application Priority Data

Apr. 5, 1990 [JP] Japan ..... 2-90927

[51] Int. Cl.[5] ..... B24D 3/18

[52] U.S. Cl. ..... 51/296

[58] Field of Search ..... 51/296

[56] References Cited

U.S. PATENT DOCUMENTS 4,729,853 3/1988 von Bonin ..... 106/18.13

FOREIGN PATENT DOCUMENTS 01286975 11/1989 Japan .

02204355 8/1990 Japan .

*Primary Examiner*—William R. Dixon, Jr.

*Assistant Examiner*—Margaret V. Einsmann

*Attorney, Agent, or Firm*—Oliff & Berridge

[57] ABSTRACT

Disclosed is a method of producing porous vitrified grinder, where melamine cyanurate is used as a pore-imparting agent. The grinder has a long life and has an improved grinding capacity.

5 Claims, No Drawings

METHOD OF PRODUCING POROUS VITRIFIED GRINDER

FIELD OF THE INVENTION

The present invention relates to a method of producing a porous vitrified grinder and, more precisely, to that of producing a porous vitrified grinder where melamine cyanurate is used as a pore-imparting agent.

BACKGROUND OF THE INVENTION

A grinder which is generally called a vitrified wheel grinder is one to be produced by blending and stirring grinding grains of a main raw material and an inorganic clay material (secondary binder) having a function of binding such grains followed by shaping the resulting blend and sintering it at a high temperature of about 1300° C. or so. The grinder of the kind may be grouped into the following two groups, depending upon the difference in the blending and shaping method.

Precisely, one is to blend and stir grinding grains and an inorganic clay material (secondary binder) whereupon a large amount of water is added thereto to give a slurry and the resulting slurry is cast into a determined casting mold and dried and shaped therein (wet-stirring cast-molding method).

The other is to blend and stir grinding grains and an inorganic clay material (secondary binder) whereupon an extremely small amount of water or fats or oils is added thereto along with an organic binder (primary binder) and the resulting blend is introduced into a determined mold and shaped therein under pressure with an oil press or the like (dry-stirring compression-molding method).

By either of the methods, vitrified grinder products characteristically having fine combined pores are produced. However, if the products are needed to have much more pores, various pore-imparting agents may be added at the step of blending or stirring so as to elevate the porosity of the products. Porous vitrified grinders as produced by such an additional treatment are generally called porous grinder wheels.

In general, substances capable of being used as a pore-imparting agent in the treatment must be such that are fired or sublimed at a temperature of up to 500° to 600° C. For instance, such substances include wood powder, acrylic resins, styrol resins, polyester resins, naphthalene, camphor, and aqueous hydrogen peroxide solution (this is reacted with an iron material to give pores, which, however, is a technique specific only to a cast molding method).

However, since the known pore-imparting agents which have heretofore been used in the conventional methods of producing porous grinders are extremely unstable with respect to the chemical property, the conventional methods have various technical problems which would hardly be solved.

Regarding the latter dry-stirring compression-molding method, since almost all of the conventional pore-imparting agents, for example, wood powder, acrylic resins, styrol resins and polyester resins, are extremely soft and are somewhat elastic as compared with the main raw materials of grinders, there are some problems to be caused by such pore-imparting agents of themselves. Precisely, these pore-imparting agents are contracted at the time when they are compressed under pressure with a press but are re-expanded at the time after the imparted pressure has been relaxed. Therefore, the agents often give large cracks in the inside of the grinders produced. Additionally, the pore-imparting agents have other drawbacks that some give ash after fired (wood powder) and some are liquefied before fired (polyester resin). Although naphthalene and camphor are free from such problems, they sublime at room temperature so that handling of them is much more difficult than wood powder and polyester resins. Because of the reasons, the amount of the pore-imparting agent capable of being added to the compression-molding method is to be naturally limited. Despite of various possible improvements of the pore-imparting agents, addition of the agent is possible in an amount of only at most about 5 to 6% by weight to the total amount of the blend of the raw materials of the grinder to be produced and the pore-imparting agent.

Next, regarding the former wet-stirring cast-molding method, the pore-imparting agent may be added to the method in an amount of several times of the compression-molding method. In this respect, the cast-molding method could be said to be an ideal one for producing porous grinders. On the other hand, however, the intrinsic drawbacks of the method of itself must not be disregarded. Precisely, the method requires an extremely long period of time after the raw material slurry has been cast into the mold frame and before the cast slurry is completely dried and shaped therein. In particular, where a large-sized grinder or a grinder of fine grains is to be produced by the method, the method often needs a drying time of several months. Additionally, as an extremely large amount of water is used in stirring and blending the raw materials, the technique of controlling the stirring and blending step is noticeably difficult and the difficulty of the controlling technique could not be disregarded. For instance, fluctuation of the pH value of water to be added to the step often varies the hardness of the products to be produced by the method. In short, it must be said that the cast-molding method is one having an extremely poor production yield and therefore the method is an extremely disadvantageous one in view of the current situation of desiring depression of the manufacture cost and elevation of the quality of the products. As mentioned above, the conventional methods of producing porous grinders have various problems to be overcome.

SUMMARY OF THE INVENTION

In view of the above-mentioned problems in the prior art, the present inventors variously investigated and studied and, as a result, have found surprisingly that the problems can be overcome by using melamine cyanurate as a pore-imparting agent in producing grinders.

Precisely, they have found that grinder products as produced by compression molding of raw materials in the presence of melamine cyanurate are free from cracks and that the amount of the additive of melamine cyanurate to be added may be elevated up to about 40 % by weight or so of the total amount of the raw materials to be molded. The elevated amount of the additive is comparable to that which is applicable to cast molding. Additionally, since melamine cyanurate completely sublimes at a temperature up to 400° C., it has no influence on the grinder product during or after sintering.

From the above-mentioned facts, the present inventors have found and confirmed that grinder products, which are comparable to those produced by cast molding, can be produced even by compression molding by using melamine cyanurate as a pore-imparting agent. On the basis of the finding, they have completed the present invention.

Accordingly, the object of the present invention is to provide a method of producing an excellent porous vitrified grinder, which is free from the drawbacks of the conventional methods.

Specifically, there is provided in accordance with the present invention a method of producing a porous vitrified grinder, which is characterized by using melamine cyanurate as a pore-imparting agent.

DETAILED DESCRIPTION OF THE INVENTION

Melamine cyanurate to be used in the method of the present invention is an adduct of melamine and cyanuric acid, which is known as a flame retardant for nylons and which is easily available. Where this is used as a pore-imparting agent in producing a porous grinder in accordance with the present invention, it may be in the form of a powder. Preferably, it is in the form of a granule comprising grains having a grain size of from 100 to 600 microns.

As the grinding grains, conventional ones which have heretofore been known in this technical field are employable, which include, for example, oxides such as alumina or silicon oxide, carbides such as silicon carbide, titanium carbide or boron carbide, nitrides such as silicon nitride or titanium nitride, as well as diamond.

As the organic binder of a primary binder, any conventional one is usable, which is, for example, dextrin. As the secondary binder, any conventional one is also usable. For instance, there are mentioned feldspar, toseki (pottery stone), gairome (frog-eye) clay, and various frits.

Blending of the grinding grains, primary binder, secondary binder and melamine cyanurate may be effected by any conventional dry stirring method. The amount of melamine cyanurate to be added may be 40% by weight or less, preferably 30% by weight or less, to the total amount of the components to be blended. It is necessary to somewhat vary the water content in the blend in accordance with the amount of the melamine cyanurate to be added thereto, but the value of the water content to be adjusted does not so much overstep the conventional range. For instance, where 3 parts of a secondary binder and 3 parts of melamine cyanurate are added to 10 parts of grinding grains (aluminium oxide, WA #150), the content of the grinding grains in the grinder to be produced therefrom is about 32% or so. Where the value is compared with the data in the standard table of showing textures of various vitrified grinders (as defined in JIS R6210), it is understood that the grinder having the value is much more porous than that having a grain content of 42% and judged to have a porous texture in the table.

From the fact, it is recognized that melamine cyanurate may produce all grinders of ordinary textures for general use.

Regarding compression molding to be applied to the present invention, any conventional one may be employed, using a pressing means or the like. Where the amount of melamine cyanurate to be added is up to 40 % or so to the weight of the total components to be blended, products with no crack can be produced.

After shaped, the shaped body may be dried by any conventional drying method where the drying temperature may be 80° to 150° C. After dried, the dried body may be fired by any conventional firing method where the firing temperature may be 1200° to 1350° C. In the firing step, the method of the present invention of using melamine cyanurate gives much less smoke or smell than the method of using acrylic resins or polyester resins.

As mentioned above, the porous vitrified grinder of the present invention, which is produced by the method of using melamine cyanurate as a pore-imparting agent, has many pores with extremely broad spaces therebetween, and therefore it has an extremely excellent property. Precisely, where the grinder of the present invention is used, the time necessary for cutting and polishing may be shortened noticeably and additionally an extremely precious cut and polished surface can be obtained.

Moreover, since the grinder of itself has an extremely excellent abrasion resistance as compared with any other non-porous grinders having the same grinding capacity, the porous vitrified grinder of the present invention has noticeably improved grinding capacity and capability.

Next, the present invention will be explained in more detail by way of the following examples and comparative examples, which, however, are not intended to restrict the scope of the present invention.

EXAMPLE 1

10 kg of grinding grains of alumina (WA #150), 0.2 kg of a primary binder of dextrin, 150 g of water, 2.3 kg of a secondary binder (comprising feldspar, toseki, gairome clay and lime and having a chemical composition of $SiO_2$ of 67.7 %, $Al_2O_3$ of 21.0 %, $Na_2O$ of 4.7% , $K_2O$ of 1.9 %, $Fe_2O_3$ of 0.4 %, CaO of 2.1 % and MgO of 0.1 %), and 1 kg of granules of melamine cyanurate (having grain size of from 300 to 400 microns) were blended and stirred, and the resulting blend was cast into a mold having a length of 155 mm, a width of 105 mm and a thickness of 30 mm and shaped therein under pressure with a hydraulic press machine (oil pressure: 100 $kg/cm^2$). The shaped body was then taken out from the mold, dried at 100° to 120° C. for 6 hours and then fired at 1280° C. for 4 hours. After cooled, the sintered body was cut into a shape of 150×15×15 mm and dipped in a molten sulfur to form a honing grinder sample for evaluation.

EXAMPLES 2 AND 3

The same process as in Example 1 was repeated, except that grinding grains of Green Carborundum (GC #240) were used and the components were blended in the proportion as indicated below. In Example 2, a grinder sample for evaluation having a size of 100×10×8 mm was prepared. In Example 3, a grinder sample for evaluation having a size of 100×10×10 mm was prepared.

| | Amounts of Ingredients (kg) | | |
|---|---|---|---|
| | Grinding Grains | Secondary Binder | MC(*) |
| Example 2 | 10 | 2.2 | 1.2 |
| Example 3 | 10 | 1.9 | 1.2 |

(*)MC = Melamine Cyanurate

COMPARATIVE EXAMPLES 1 TO 3

The same process as in Example 1 was repeated to prepare comparative honing grinder samples for evaluation, except that the pore-imparting agent of melamine cyanurate was not added. In Comparative Example 1, the same grinding grains as those used in Example 1 were used. In Comparative Examples 2 and 3, the same grinding grains as those used in Example 2 were used. The amounts of the ingredients of the comparative samples are mentioned below. Regarding the shape of the comparative samples, the shape of the sample of Comparative Example 1 was same as that of Example 1; that of Comparative Example 2 was same as that of Example 2; and that of Comparative Example 3 was same as that of Example 3.

| | Amounts of Ingredients (parts) | |
|---|---|---|
| | Grinding Grains | Secondary Binder |
| Comparative Example 1 | 10 | 1.7 |
| Comparative Example 2 | 10 | 1.5 |
| Comparative Example 3 | 10 | 1.9 |

COMPARATIVE EXAMPLE 4

The same process as in Example 1 was repeated, except that 1 kg of wood powder was added as a pore-imparting agent in place of melamine cyanurate.

The sintered body formed during the process was cracked.

EVALUATION 1

The grinder samples produced in Example 1 and Comparative Example 1 were tested with respect to the grinding capacity of grinding a drawn steel pipe (180ϕ×150 mm). In the test, one set comprising four grinder samples in each case was used, and the test conditions were as mentioned below.

Grinding Test Condition

| | |
|---|---|
| Number of Rotation: | 60 r.p.m. |
| Honing Oil: | Nippon Grease No. 10 |
| Gauge Pressure: | 16 kg/cm$^2$ |

Results

In the case of using the grinder samples of Example 1, the working time was 40 minutes. Regarding the life in the case, the grinder sample was exchanged by a new one after used for grinding five works (steel pipes to be ground). As opposed to the case, however, in the case of using the grinder samples of Comparative Example 1, the working time was 60 minutes. Regarding the life in the case, the grinder sample must be exchanged by a new one after used for grinding three works. From the results, it is understood that the working time with the grinder obtained by the method of the present invention is shorter than that with the comparative grinder and that the life of the grinder of the invention is longer than that of the comparative grinder.

EVALUATION 2

The grinder samples produced in Example 2 and Comparative Example 2 were tested with respect to the grinding capacity of grinding a cylinder liner (82ϕ×152 mm). In the test, one set comprising four grinder samples in each case was used, and the test conditions were as mentioned below.

Grinding Test Condition

| | |
|---|---|
| Number of Rotation: | 60 r.p.m. |
| Honing Oil: | Kerosene |
| Gauge Pressure: | Low Pressure 6 kg/cm$^2$<br>High Pressure 11 kg/cm$^2$ |

Results

In the case of using the grinder samples of Example 2, the working time was 50 seconds. Regarding the life in the case, the grinder sample was exchanged by a new one after used for grinding 200 works (cylinder liners to be ground). As opposed to the case, however, in the case of using the grinder samples of Comparative Example 2, the working time was 60 seconds. Regarding the life in the case, the grinder sample must be exchanged by a new one after used for grinding about 140 works. From the results, it is understood that the working time with the grinder obtained by the method of the present invention is shorter than that with the comparative grinder and that the life of the grinder of the invention is longer than that of the comparative grinder.

EVALUATION 3

The grinder samples produced in Example 3 and Comparative Example 3 were tested with respect to the grinding capacity of grinding a two-cycle engine cylinder (46×71.2 mm). In the test, one set comprising twelve grinder samples in each case was used, and the test conditions were as mentioned below.

Grinding Test Condition

| | |
|---|---|
| Number of Rotation: | 260 r.p.m. |
| Honing Oil: | Yushiro H-35 |

Results

In the case of using the grinder samples of Example 3, the working time was 50 seconds. Regarding the life in the case, the grinder sample was exchanged by a new one after used for grinding 100 works (cylinder to be ground). As opposed to the case, however, in the case of using the grinder samples of Comparative Example 3, the working time was 60 seconds. Regarding the life in the case, the grinder sample was exchanged by a new one after used for grinding about 100 works. The circularity and the cylindricality of the worked engine cylinders were as mentioned below. From the data, the superiority of the grinder obtained by the method of the present invention over the comparative grinder is obvious.

| | Example 3 | Comparative Example 3 |
|---|---|---|
| Circularity | 1 microns | 4.5 microns |
| Cylindricality | 1.5 microns | 3.5 microns |

While the invention has been described in detail and with reference to specific embodiments thereof, it will be apparent to one skilled in the art that various changes and modifications can be made therein without departing from the spirit and scope thereof.

What is claimed is:

1. A method of producing a porous vitrified grinder comprising: blending melamine cyanurate having a particle diameter of from 100μ to 600μ with grinder grains and at least one binder material to produce a blend; and applying compression molding to the blend.

2. The method of producing a porous vitrified grinder as claimed in claim 1, in which the amount of melamine cyanurate to be blended is 40% by weight or less of the total weight of the components to be blended for producing the grinder.

3. The method of producing a porous vitrified grinder as claimed in claim 1, in which the amount of melamine cyanurate to be blended is 30% by weight or less of the total weight of the components to be blended for producing the grinder.

4. The method of producing a porous vitrified grinder as claimed in claim 1, further comprising drying the shaped body after the step of compression molding.

5. The method of producing a porous vitrified grinder as claimed in claim 4, further comprising firing the dried shaped body after the step of drying.

* * * * *